United States Patent [19]

Engle

[11] Patent Number: 4,714,035

[45] Date of Patent: Dec. 22, 1987

[54] PLACKET LINING MACHINE

[75] Inventor: Elbert Engle, Ashville, Ala.

[73] Assignee: Chesebrough-Pond's, Inc.

[21] Appl. No.: 889,317

[22] Filed: Jul. 23, 1986

Related U.S. Application Data

[62] Division of Ser. No. 498,463, May 31, 1983, Pat. No. 4,606,286.

[51] Int. Cl.[4] ..... D05B 3/10

[52] U.S. Cl. ..... 112/114; 225/101; 83/107; 83/154; 269/45

[58] Field of Search ..... 112/114, 121.12, 121.15, 112/260, 121.26; 225/101, 105; 83/107, 105, 455, 154; 269/45, 37

[56] References Cited

U.S. PATENT DOCUMENTS

| | | | |
|---|---|---|---|
| 2,359,035 | 9/1944 | Gunther | 112/114 |
| 2,930,515 | 3/1960 | Hopkins | 225/101 |
| 3,669,048 | 6/1972 | Dunn et al. | 112/121.26 |
| 3,735,716 | 5/1973 | Wilkie | 112/114 X |
| 3,921,550 | 11/1975 | Marjorio | 112/121.12 |
| 4,341,333 | 7/1982 | Boa et al. | 225/101 X |
| 4,474,319 | 10/1984 | Walker | 225/101 X |
| 4,541,353 | 9/1985 | Engle | 112/305 |

*Primary Examiner*—H. Hampton Hunter
*Attorney, Agent, or Firm*—Brumbaugh, Graves, Donohue & Raymond

[57] ABSTRACT

A machine for automatically forming a placket on a garment, for example on a front of a child's shirt, makes use of a clamping and straightening apparatus which has a pair of clamp members which engage the garment piece along a segmented edge, straighten the edge and then transport the edge past a sewing machine which attaches a strip of lining material.

6 Claims, 10 Drawing Figures

STEP 1

STEP 2

STEP 3

STEP 4

STEP 5

STEP 6

STEP 7

STEP 8

STEP 9

STEP 10

STEP 11

STEP 12

PLACKET LINING MACHINE

This application is a division of application of Ser. No. 498,463, filed on May 31, 1983 now U.S. Pat. No. 4,606,286 dated Aug. 19, 1986.

BACKGROUND OF THE INVENTION

This invention relates to automatic sewing apparatus, and particularly to apparatus for forming a placket on a garment, such as a T-shirt for children.

A placket for a T-shirt is usually formed by hand feeding the edges of a garment piece to a sewing machine to attach a strip of tape-like knitted lining material. The strip may be applied to the sewing machine automatically or by hand. The operation is a rather complex hand operation, since it requires that the operator sew the straight edge of the placket lining strip material to the segmented edge of a garment piece. Typically, the segmented edge is formed by cutting the garment piece in a straight line, so that in the limp and flat state, the garment piece has two placket edges which are adjacent to each other on opposite sides of a cut slit. The hand sewing operation requires that the operator sew the straight edge of the placket lining strip around a 180° turn of the placket edge on the garment piece.

It is an object of the prsent invention to provide an apparatus which will automatically form a placket on a piece of material, which is to form a part of a garment.

It is a further object of the present invention to provide an apparatus which will automatically sew a first piece of material having a straight edge to a second piece of material having a segmented edge.

SUMMARY OF THE INVENTION

In accordance with the invention there is provided an apparatus for clamping and straightening a segmented edge on a piece of material. The apparatus includes a clamp support which is moveable between clamping and unclamping positions. There are also provided at least two clamp members mounted to the clamp support. One of the clamp members is arranged to pivot with respect to the support and with respect to the other clamp member on a pivot axis. There are further provided means for adjusting the spacing of the pivot axis with respect to the other clamp.

In a preferred embodiment, the adjusting means includes a lever which is pivotably mounted to the support and carries the pivot axis. The clamp support may be arranged above a work table so that it engages the work table in the clamping position. The clamp support may be mounted on a vertically fixed and horizontally moveable carriage which is above the work table. In one embodiment, both of the clamp members pivot with respect to the support about first and second pivot axes. The adjusting means adjusts the spacing of the first and second pivot axes.

In accordance with the invention, there is provided an apparatus for sewing a first piece of material having a straight edge to a second piece of material having a segmented edge when the second piece is in a flattened condition. The apparatus includes a work table and a sewing machine having a sewing head mounted to receive and sew material on the work table. There are provided means for supplying the first piece to the sewing head and a carriage arranged for horizontal transport with respect to the sewing head. A first clamp is mounted on the carriage and arranged for vertical motion with respect to the work table to clamp against the work table. The first clamp is arranged for pivoting about a first vertical axis. There is also provided a second clamp, which is mounted on the carriage and arranged for vertical motion with respect to the work table to clamp against the work table. There are provided means for adjusting the relevant positions of the first axis and the second clamp and control means for operating the carriage, the clamps and the adjusting means to clamp the second piece of material in the flattened condition and to pivot the clamp and adjust the pivot axis to straighten the segmented edge, and to transport the edge past the sewing head while the supplying means supplies the first piece.

In one embodiment, there is provided a third clamp which engages the second piece of material in a position between the first and second clamps. The first and second clamps may be arranged on a clamp support which is arranged for vertical motion with respect to the carriage.

A preferred arrangement of the invention is for operating on a second piece of material which has a segmented edge including first and second segments which meet at an inside angle. The inside angle in one embodiment is essentially a zero degree angle, so that the first and second segments comprise opposite sides of a slit. In this case, the first and second clamps can engage the first and second segments and pivot by an angle of approximately 90° each to straighten the first and second segments to form a straight edge. There may also be provided an arrangement for automatically cutting the second piece of material to form the first and second segments. The first piece of material may comprise a continuous strip and means may be provided for cutting the strip. A stacking mechanism may be provided for receiving and stacking the sewn pieces. The control of the machine can include means for sensing the speed of the sewing machine and for coordinating the speed of movement of the carriage and the speed of supply of the strip to the sewing machine with the speed of the sewing machine. In a preferred embodiment of the invention, the entire operation is controlled by a programmed microprocessor.

In accordance with the invention, there is provided a method for sewing along a segmented edge on a piece of material, which include the steps of clamping the material along the segmented edge with a plurality of clamps. The clamps are arranged to pivot with respect to each other and have adjustable clamp spacing. The clamps are pivoted while adjusting the clamp spacing thereby to straighten the edge and the clamps are transported with the straightened edge past the sewing head of a sewing machine thereby to sew along the edge.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
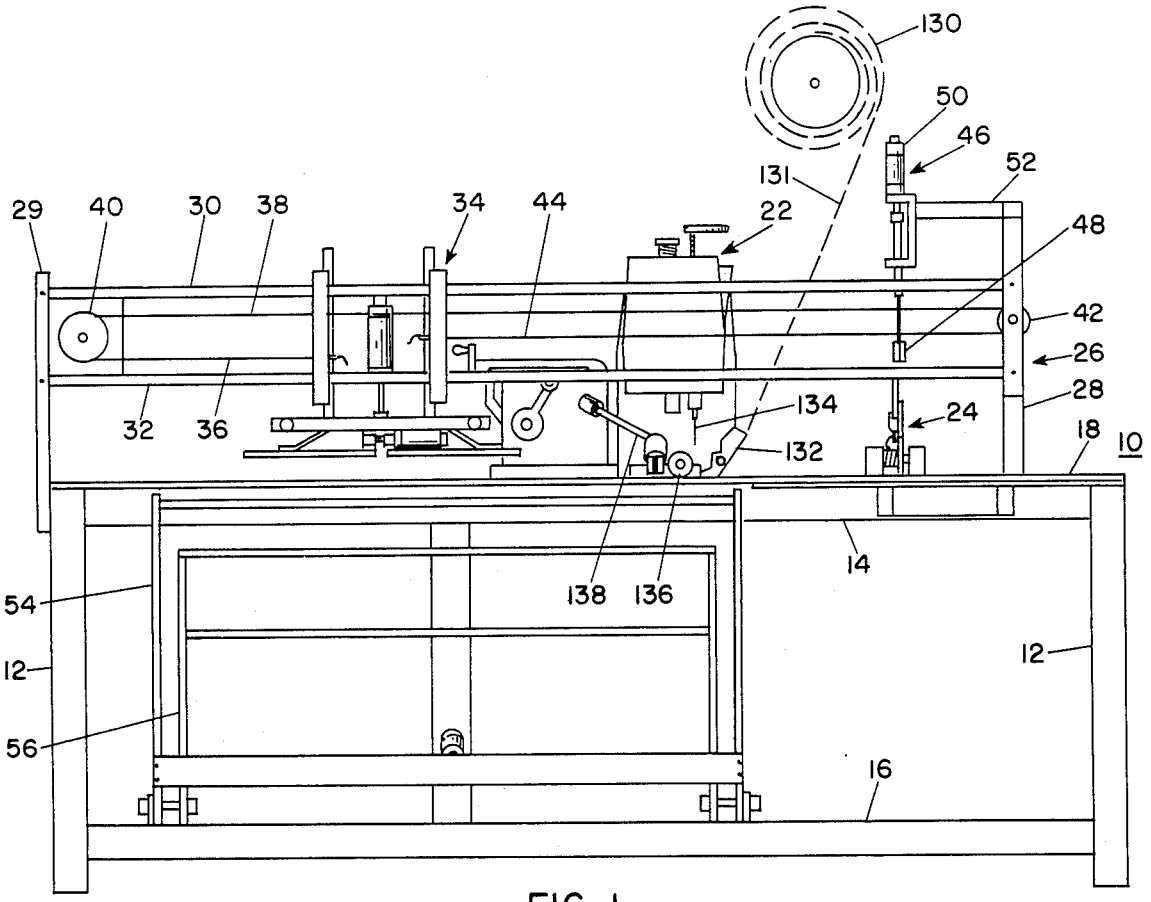
FIG. 1 is an elevation plan view of an apparatus in accordance with the present invention.
Figure 2:
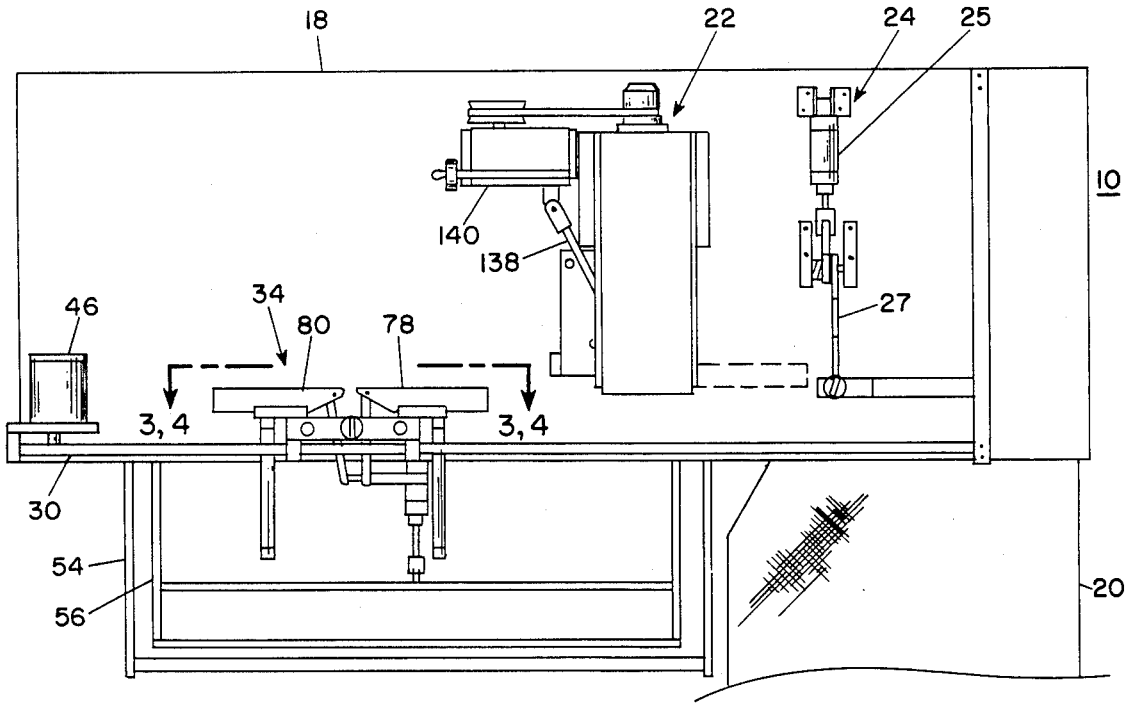
FIG. 2 is a top view of the FIG. 1 apparatus.
Figure 3:
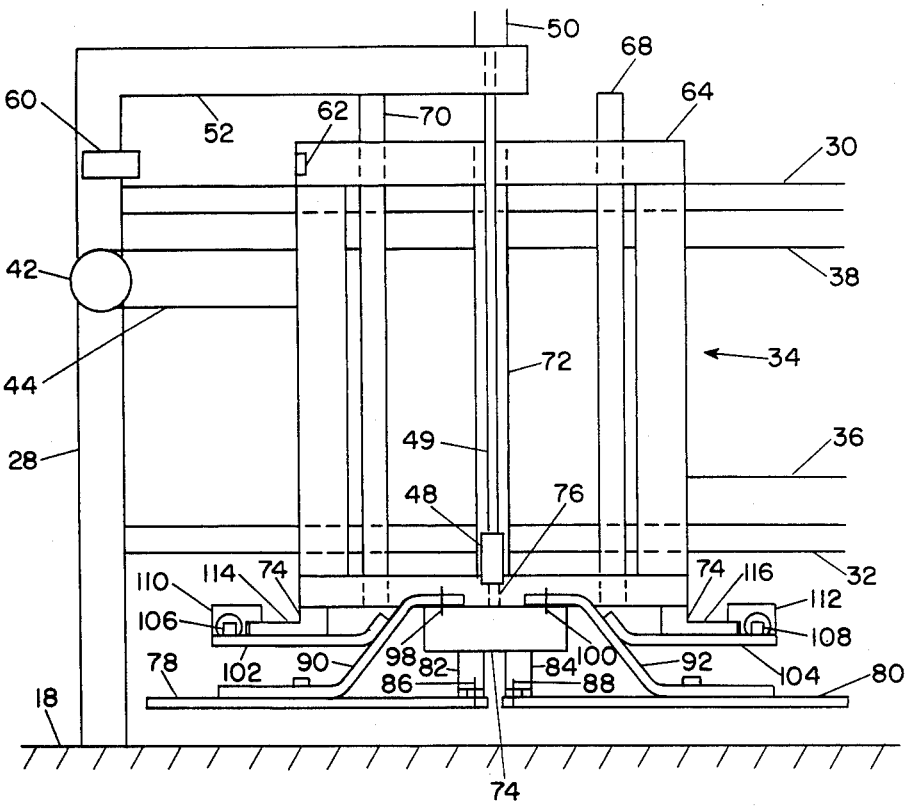
FIG. 3 is an elevation plan view of the carriage mechanism used in the FIG. 1 apparatus.
Figure 4:
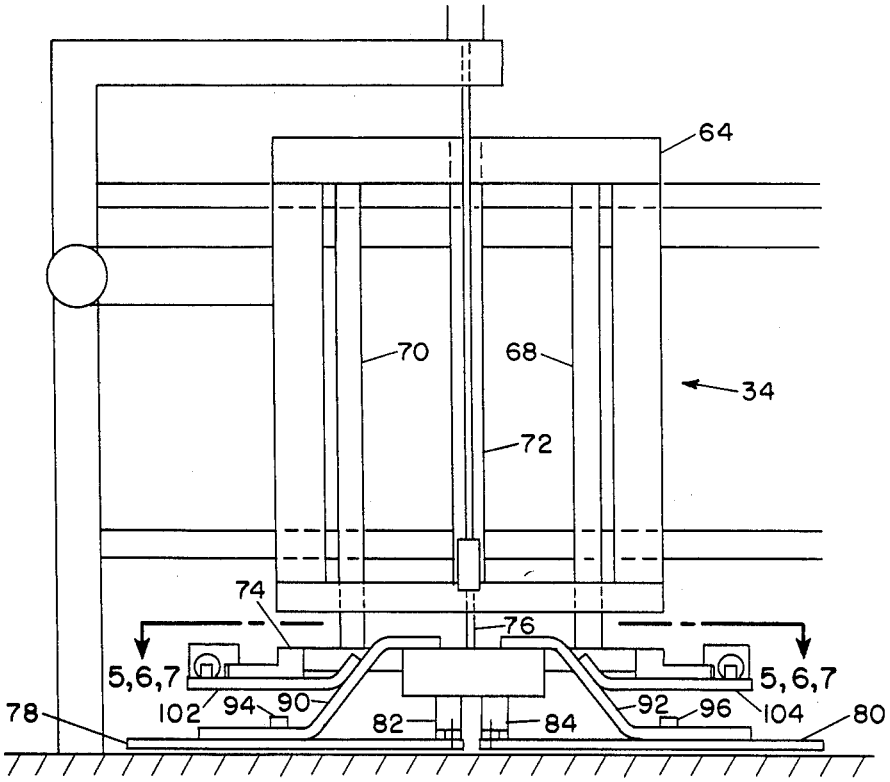
FIG. 4 is an elevation plan view of the carriage apparatus shown in FIG. 3 in the clamping position.

Referring to FIGS. 1 and 2 there are shown side and top views of an apparatus 10 for clamping and sewing material in accordance with the present invention. The apparatus 10 is particularly useful for sewing a placket to a shirt front and for forming a slit in the shirt front to which the placket is to be sewn. The apparatus 10 includes a work table having vertical members 12 which support a horizontal work surface 18. The work table further includes horizontal structural members 14 and 16. The work table is provided with a platform extention 20 at the same vertical height as platform 18. Together the surfaces 18 and 20 form a work table in a generally L-shaped configuration.

Mounted on work table 18 is a sewing machine 22, which in the illustrated embodiment is Rimoldi sewing machine having an added roller 136 and guide 132 for applying a woven tape 131 from spool 130.

Also mounted on work table 18 is a cutting apparatus 24, which includes an air driven cylinder 25 and a cutting blade 27. The cutting apparatus 24 is arranged for forming a slit in a shirt front to which a placket lining is to be sewn, as will be further explained. A vertical extention 26 mounted on table 18 includes horizontal tracks 30 and 32 mounted to vertical support members 28 and 29 for supporting a carriage 34 which is moveable horizontally to the left and right in FIGS. 1 and 2. Carriage 34 is arranged to roll on tracks 30 and 32 under the influence of a cable which has segments 36, 38 and 44 engaging pulleys 40 and 42. Motor 46 is arranged to move cable 36, 38 and 44 in a manner which draws carriage 34 to the left and right. Motor 46 is a stepper motor which is operated under the control of a programmed microprocessor, as will be further explained. Also mounted on table 18 is a clamping mechanism 46 which includes a support 52 and an air cylinder 50 which is arranged to move clamping member 48 in a vertical direction to engage the top of surface 18 when piston 50 is activated by the supply of compressed air. Sewing machine 22 includes a sewing needle 134 and is supplied with a tapelike woven strip 131 from spool 130. Strip 131 passes through guide member 132 and is drawn by pulley 136 which is driven by a gear 138 connected to the motor 140 of sewing machine 22.

Attached to table 18 is a stacking mechanism, which includes racks 54 and 56, which are operated by respective air cylinders to move toward and away from table top 18. Racks 54 and 56 provide for automatic stacking of finished products, as will be further explained.

FIGS. 3 through 7 show detailed views of the carriage 34 and the associated clamping mechanisms of the present invention. As previously noted, carriage 34 rides on rails 30 and 32. Carriage 34 includes a generally rectangular frame member 64 which engages rails 30 and 32 and is connected to cable segments 36 and 44 which, in connection with pulleys 40 and 42, serve to provide horizontal motion of carriage 34 and its associated clamping mechanism. Support 28 carries a magnetic field selector 60, which senses the magnetic field of permanent magnet 62 when carriage 34 is in the position closest to support 28.

Mounted to carriage 34 is a clamp support 74 which is mounted on rods 68 and 70, which are slidable in bores on frame 64. An air cylinder 72 has a piston rod 76 which provides for vertical movement of clamp support 74 between the release position shown in FIG. 3 and the clamping position shown in FIG. 4.

Figure 5:
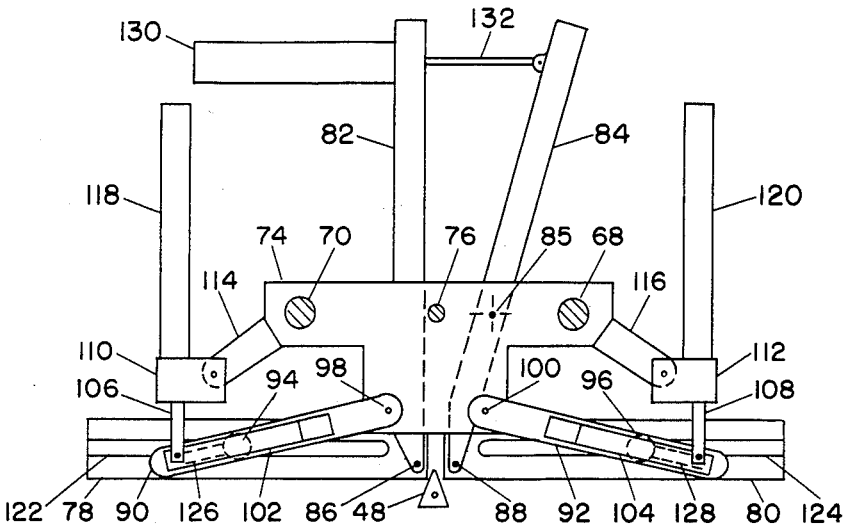
FIG. 5 is a top view of the clamps used in the clamping apparatus shown in FIGS. 3 and 4.
Figure 6:
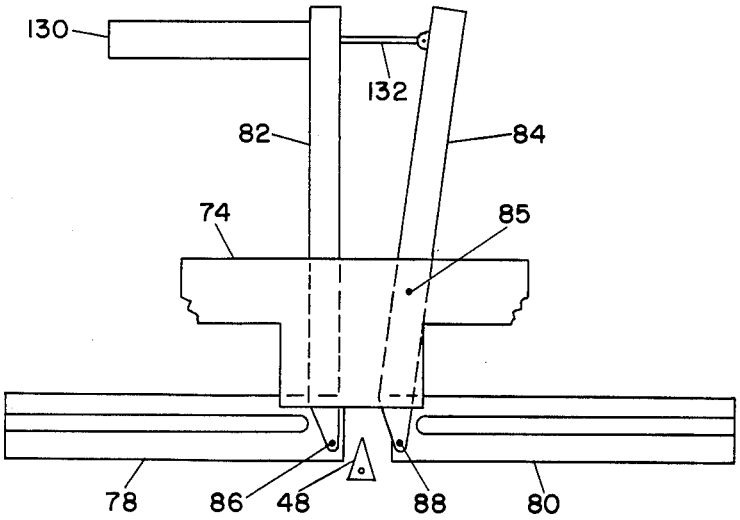
FIG. 6 is a partial top view of the clamping apparatus shown in FIGS. 3 to 5.

FIG. 5 is a top view of clamp support 74 taking a cross-section through vertical supports 68, 70 and piston rod 76 of cylinder 72. From FIGS. 3, 4 and 5 it may be seen that there are provided clamps 78 and 80 which are mounted to pivot members 82 and 84 which are connected to clamp support 74. Pivot member 82 has a fixed position with respect to clamp support 74. Likewise, pivot axis 86 has a fixed position with respect to clamp support 74. Pivot member 84 is a lever which is mounted to clamp support 74 by lever axis 85, shown in FIGS. 5 and 6, and pivotable with respect thereto on axis 85. Pivot member 84 is pivotably connected to clamp 80 on pivot axis 88. As illustrated by FIGS. 5 and 6, pivoting of pivot support lever 84 on axis 85, by the operation of air cylinder 130 drawing piston rod 132, causes a relative movement of pivot axis 88 and clamp 80 away from pivot axis 86 and clamp 78.

Clamp 78 is also connected to clamp support 74 by a connecting member 90, which has a first pivoting connection 94 between slot 126 in connecting member 90 and slot 122 in clamp 78. Connecting member 90 has a second pivoting connection 98 where connecting member 90 is mounted to the top of clamp support 74. Connecting member 90 has a lever member 102 which is connected to the piston rod 106 of air cylinder 118. Air cylinder 118 is mounted on support member 110 which is pivotably mounted to an extention 114 of clamp support 74.

Likewise, clamp 80 has a first pivoting connection 96 between slot 124 in clamp 80 and lot 128 in connecting member 92. The other end of connecting member 92 is pivotably mounted on axis 100 to the top of clamp support 74. Connecting member 92 has a lever member 104 which is connected to piston rod 108 of air cylinder 120. Air cylinder 120 is mounted on support 112, which is pivotably mounted to an extention 116 of clamp support 74.

Figure 7:
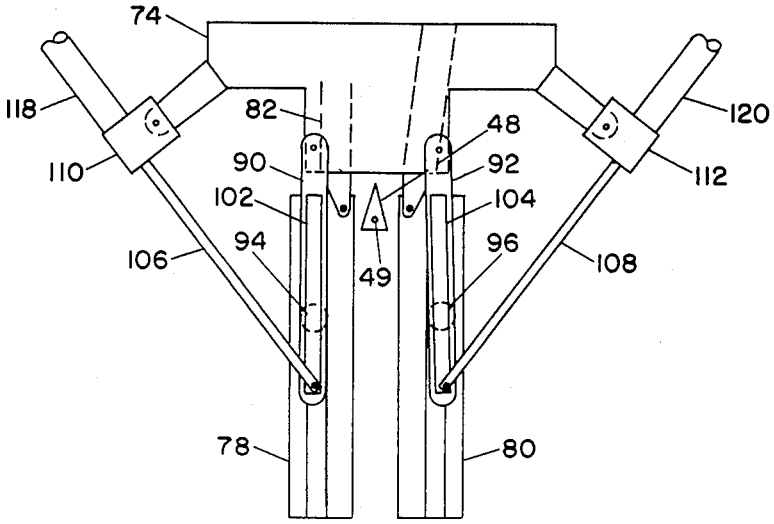
FIG. 7 is a partial top view of the clamping apparatus shown in FIGS. 3 to 6 in the pivoted position.
Figure 8A:
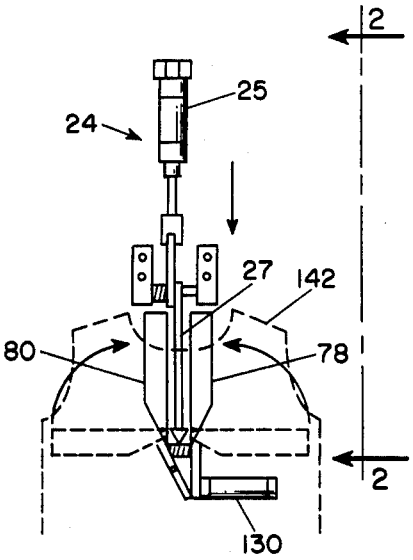
FIGS. 8*a* and 8*b* represent a set of simplified drawings showing portions of the FIG. 1 apparatus and illustrating the operation thereof.
Figure 8A:
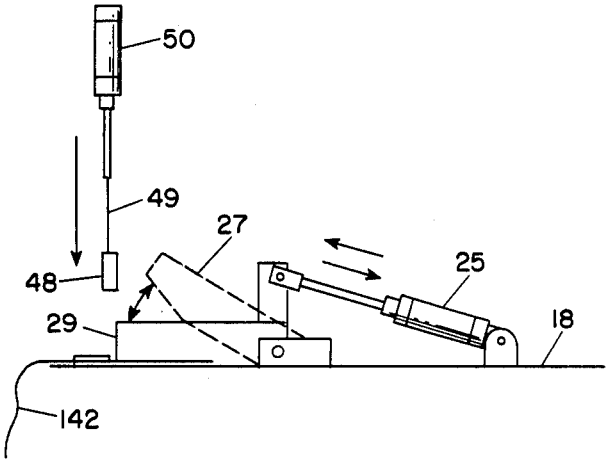
Figure 8A:
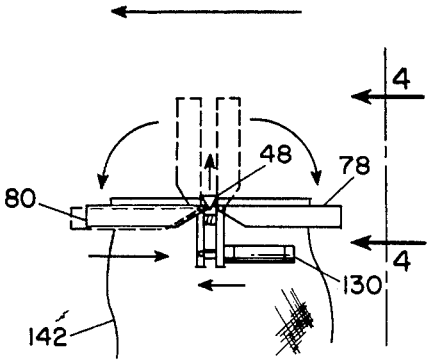
Figure 8A:
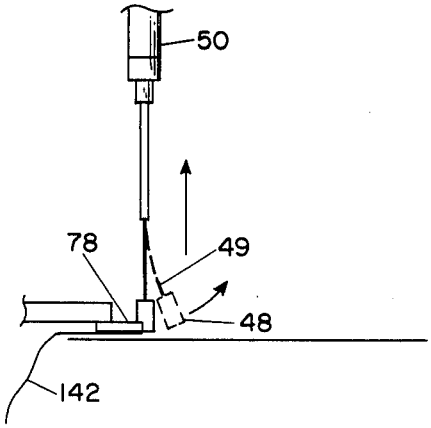
Figure 8A:
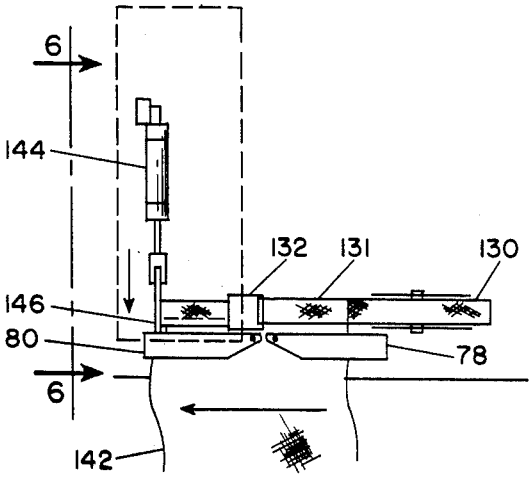
Figure 8A:
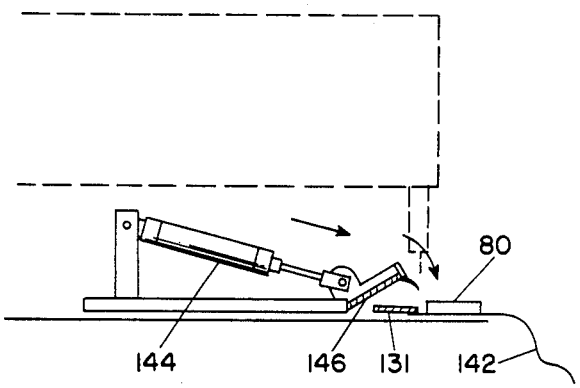
Figure 8B:
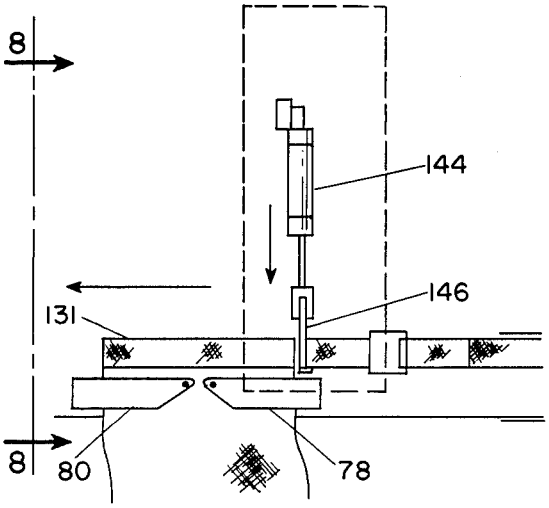
Figure 8B:
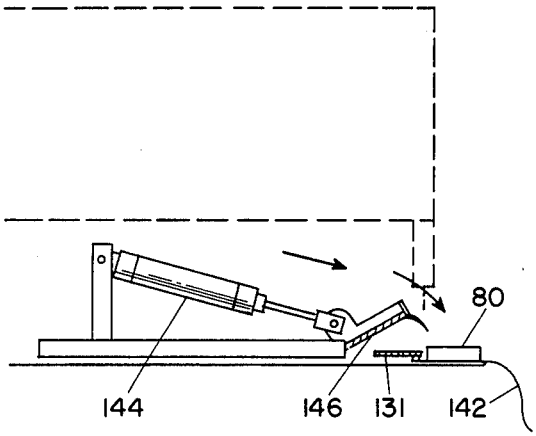
Figure 8B:
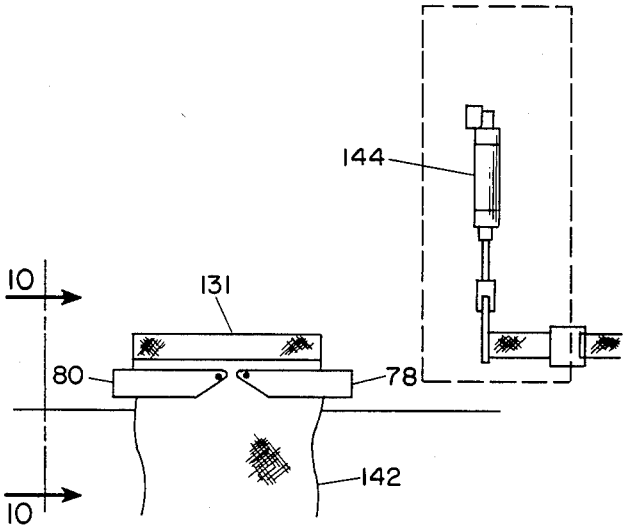
Figure 8B:
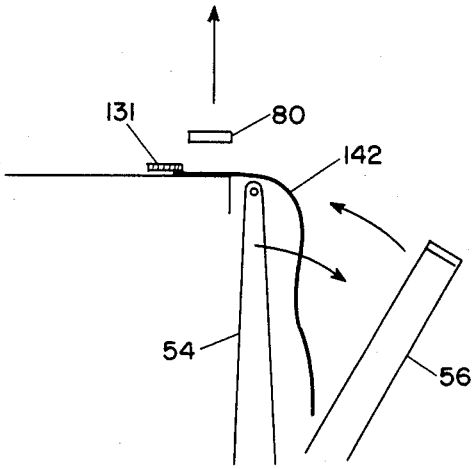
Figure 8B:
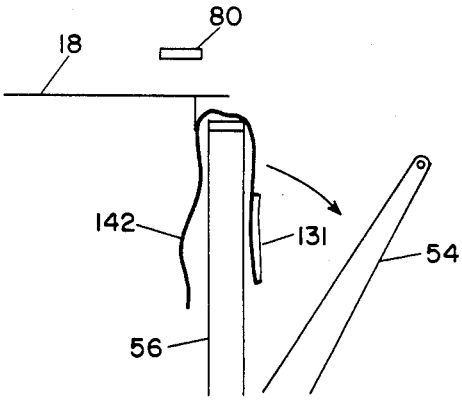
Figure 8B:
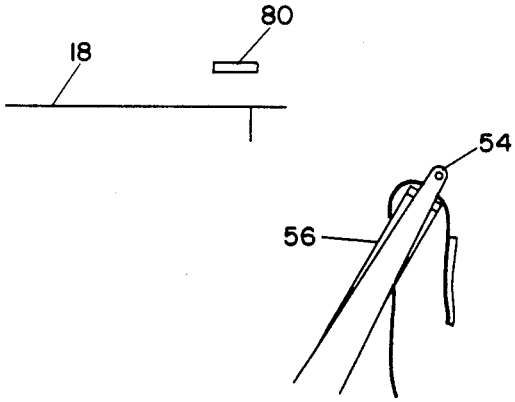

The operation of air cylinders 118 and 120 is illustrated in FIG. 7. FIG. 7 is a partial top view of clamp support 74 with pistons 118 and 120 having there respective piston rods 106 and 108 in the extended positions so that clamps 78 and 80 have been pivoted by 90° from the position shown in FIG. 6. With respect to the clamp position shown in FIG. 7, it should be noted that lever 84 is in the pivoted position, so that pivot axis 88 has been moved away from pivot axis 86. This position enables the third clamp member 48, which is separately mounted by rod 49 to mounting apparatus 52 and cylinder 50, to clamp between clamps 78 and 80.

To summarize the operations of the clamping apparatus mounted on carriage 34 in FIGS. 3 through 7, it should be noted that several independent operations are provided. Clamp support 74 is moveable between an upper disengaged position shown in FIG. 3 and a lower clamping position shown in FIG. 4. Pivot axis 88 and clamp 80 are moveable toward and away from axis 86 and clamp 78 as shown by FIGS. 5 and 6. In the view shown in FIG. 6, clamp 80 and axis 88 are moved away from clamp 78 and axis 86. This motion provides space between first and second clamps 78 and 80 for accommodating third clamp 48, which is separately mounted on rod 49 and separately operated by piston 50. Clamp 48 is moveable in an up-and-down arrangement between the position shown in FIG. 3, and a position wherein it engages table top 18 between clamp member 78 and 80 as shown in FIGS. 6 and 7. Clamps 78 and 80 are pivotable about axes 86 and 88 by the action of air cylinders 118 and 120. This operation is illustrated in FIGS. 5 and 7.

In addition to these various movements of the clamping mechanism mounted on carriage 34, it will be noted with reference to FIGS. 1 and 2 that carriage 34 is moveable across tracks 30 and 32 as driven by motor 46, that sewing machine 22 can be turned on and off, and that feed mechanism 136 can be operated to draw tape 131 into the sewing position. There is also provided a cutting mechanism 24, operated by air cylinder 25, and stacking mechanisms 54 and 56, each driven by their own air cylinder. An additional tape cutting mechanism, comprising blade 146 driven by cylinder 144 will be described with reference to FIG. 8. All of these mechanisms are preferably operated under the control of a programmed microprocessor for sewing a placket lining to a shirt front, as will be described with reference to FIG. 8.

FIG. 8 shows 12 steps by which the apparatus shown in FIGS. 1 and 2 operates on a shirt front blank to form a placket, by sewing a placket strip 131 to a slit in the shirt front. In step 1 of FIG. 8, a shirt front blank 142 is inserted onto table 18 from table 20 and positioned at the appropriate location with respect to cutting blade 27. The position may be determined by a mark on table top 18. After positioning shirt front 142, the apparatus is activated, by pressing a "start" button. Lever 84 is drawn by cylinder 130 acting through piston rod 132 to separate pivot axis 88 and clamp 80 from pivot axis 86 and clamp 78. Cylinders 118 and 120 are activated to pivot clamps 78 and 80 to a condition such that they are parallel, as shown in FIG. 7, and surrounding cutting blade 27. Following this action, clamp support 74 with clamps 78 and 80 is lowered to engage table top 18, and firmly hold shirt front 142 against the table top. At this point, third clamp 48 may engage the shirt front by the action of cylinder 50 acting on rod 49. Clamp 48 comes down between the separated first and second clamps 78 and 80, as illustrated in FIG. 7. Cylinder 25 is activated as illustrated in step 2 of FIG. 8 to cut the shirt front 142 and form a slit having opposed edges, each of which are engaged by one of clamps 78 and 80. In an alternate arrangement, clamp 48 may engage the shirt front following the action of cutting blade 27. Illustrated in step 2 is a cutting guard 29, which may also be provided as a guide to determine how far shirt front 142 is inserted with respect to blade 27.

Step 3 of FIG. 8 illustrates a separating action, by which clamps 78 and 80 are pivoted back to a position where they form a straight line holding the previously opposed edges of the slit formed by cutting blade 27 in step 2. This process forms a straight edge from the slit edges which are segmented when material 142 is in a flattened condition. During the pivoting motion of clamps 78 and 80, cylinder 130 is operated to move pivot axis 88 and clamp 80 toward pivot axis 86 and clamp 78, also forcing clamp 48 outwardly with respect to clamp support 74 because of the triangular shape of clamp 48. The combined action of the pivoting of clamp 78 and 80, their motion together by the action of lever 84, and the action of clamp member 48, illustrated in step 4 of FIG. 8 moving in an outwardly direction, enables the straightening of the segmented edges of the seam to be performed without placing a strain on the material which might cause the material to tear at the end of the cut slit.

Following the straightening of clamps 78 and 80, during which action they remain clamped against table 18 by clamp support 74 in the lower position, clamp 48 is drawn upwardly by piston 50 to disengage from the material. At this point, motor 46 is activated to start horizontal motion of carriage 34, carrying clamps 78 and 80 and the material engaged thereby into a position to be operated on by sewing machine 22. As the clamps reach sewing machine 22, as shown in step 5 of FIG. 8, the machine is started automatically, also starting the operation of wheel 136 which draws placket tape 131 from spool 130, while sewing the placket tape to the straightened edge of the material. When the sewn edge reaches cutting blade 146, the cutting blade 146 is operated by cylinder 144 to cut tape 131 even with the leading edge of the material 142. This cutting operation is also illustrated in the side view of step 6 of FIG. 8.

Step 7 of FIG. 8 shows the completion of the sewing operating wherein the placket strip 131 has been attached to material 142 while the material is still held by clamps 78 and 80. Cylinder 144 is again activated to cause cutting blade 146 to cut the trailing edge of the tape 131 even with the trailing edge of the material 142. As the sewing process is completed, sewing machine 22 and wheel 136 are deactivated. In step 8 of FIG. 8 the cutting action shown in step 7 is illustrated in side view.

Step 9 of FIG. 8 shows the material piece 142 with the sewn placket strip 131 after it leaves the sewing process. The unclamped end of material 142 hangs over the edge of table top 18. As shown in step 10 of FIG. 8, rack 54 has previously moved into a position adjacent table top 18, so that material piece 142 has been draped over rack 54 during the sewing process. Rack 56 is then moved toward table 18 to engage the material piece 142 while clamp support 74 moves up to disengage clamps 78 and 80. In step 11 of FIG. 8, rack 54 is moved away so that the material piece 142 is drapped over rack 56. In step 12 of FIG. 8 the rack 56 holding a stack of finished goods is returned to its rest position away from table 18. Carriage 34 is then returned to its rest position by the operation of stepper motor 46 to repeat the process with another piece of material.

Figure 9:
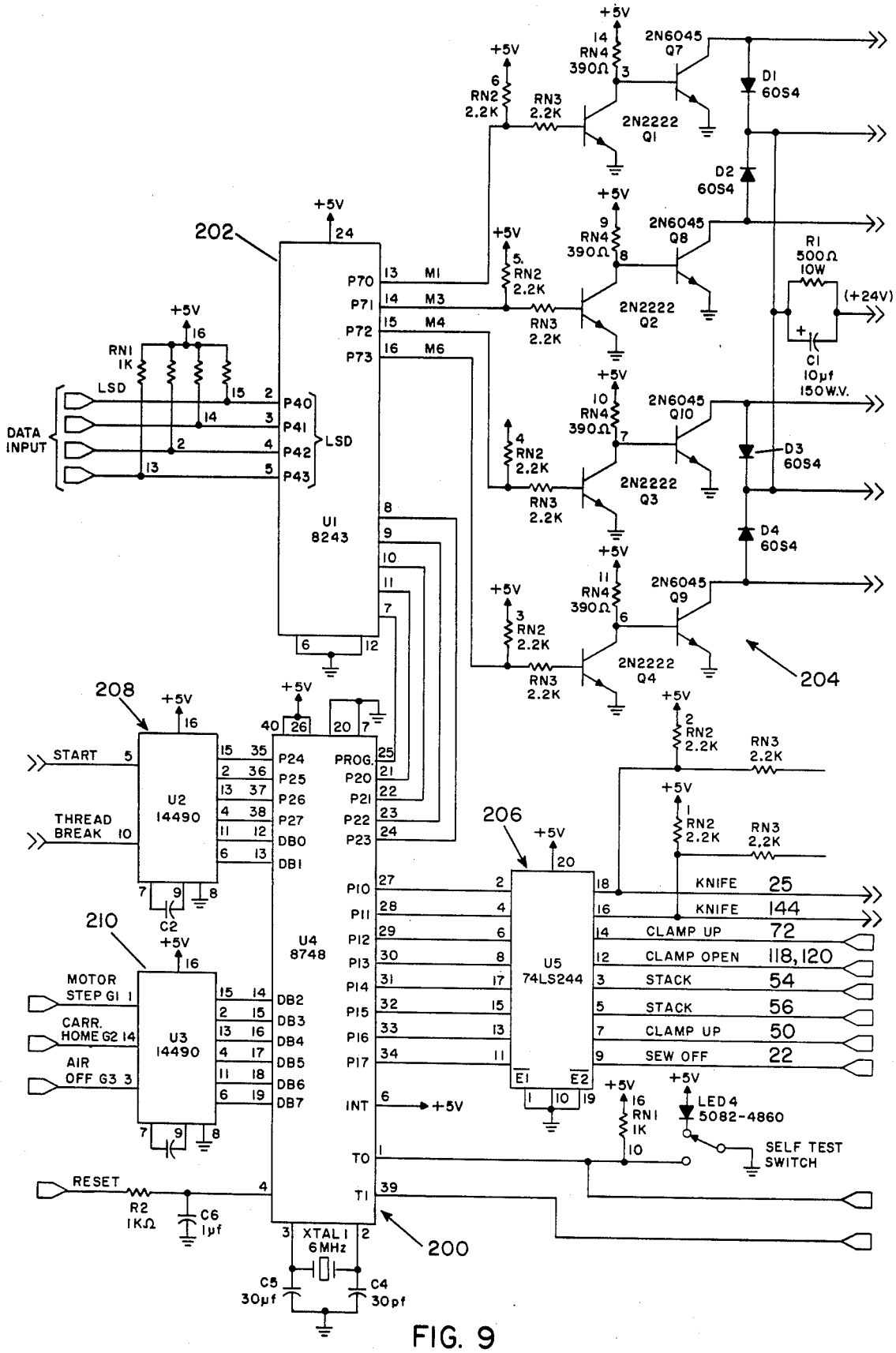
FIG. 9 is a circuit diagram showing a control circuit for the FIG. 1 apparatus.

FIG. 9 is a schematic diagram of a microprocessor circuit for controlling the operation of the FIG. 1 apparatus. The FIG. 9 circuit includes a microprocessor 200, which includes a control program as set forth in the microfische appendix to this application. Port expander 202 is provided which contains outputs connected to driver circuits 204 for controlling the operation of stepper motor 46. Port expander 202 also provides for input data on ports P40 through P 46 which are taken from a thumb wheel control input which regulates the length of the placket which is to be sewed onto a shirt front. Input ports 208 and 210 include terminals for receiving controls from the start switch and other terminals for receiving signals indicating breakage of the sewing machine thread, stepping of the sewing machine, carriage 34 in its home position adjacent magnetic field sensor 60, and the lack of compressed air supply. The sewing machine step input is derived from a magnetic sensor adjacent the hand wheel of sewing machine 22, which provides a pulse signal with each rotation of the sewing machine shaft. This signal is used for coordinating the operation of stepper motor 46 to the speed of sewing machine 22. Microprocessor 200 is also connected to output buffer 206, which has output ports for controlling air valves which operate the various air cylinders, including the two cutting knives having cylinders 25 and 144, the clamp support 74 operated by cylinder 72, clamp pivoting operated by cylinders 118 and 120, the two racks 54 and 56 operated by their respective cylinders, the operation of third clamp 48 by cylinder 50, and the on/off control for sewing machine 22.

While there has been described what is believed to be the preferred embodiment of the present invention, those skilled in the art will recognize that other changes and modifications may be made thereto without departing from the spirit of the invention, and it is intended to claim all such changes as fall within the true scope of the invention.

I claim:

1. Apparatus for clamping and straightening a segmented edge on a piece of material comprising a clamp support moveable between clamping and unclamping positions, at least two clamp members mounted to said clamp support, at least one of said clamp members being arranged to pivot with respect to said support and said other clamp member on a pivot axis, and means for adjusting the spacing of said pivot axis with respect to said other clamp.

2. Apparatus as specified in claim 1 wherein said means for adjusting includes a lever pivotably mounted to said support and carrying said pivot axis.

3. Apparatus as specified in claim 1 wherein said clamp support is arranged above a work-table and engages said table in said clamping position.

4. Apparatus as specified in claim 3 wherein said clamp support is mounted on a vertically fixed, horizontally moveable carriage above said table.

5. Apparatus as specified in claim 1 wherein both of said clamp members pivot with respect to said support about first and second pivot axes.

6. Apparatus as specified in claim 5 wherein said adjusting means is for adjusting the spacing of said first and second pivot axes.

* * * * *

UNITED STATES PATENT AND TRADEMARK OFFICE

CERTIFICATE OF CORRECTION

PATENT NO. : 4,714,035

DATED : December 22, 1987

INVENTOR(S) : Elbert Engle

It is certified that error appears in the above-identified patent and that said Letters Patent is hereby corrected as shown below:

Col. 2, line 47, "include" should be --includes--;
Col. 3, bridging lines 23-24, "extention" should be --extension--;
Col. 3, line 36, "extention" should be --extension--;
Col. 4, line 38, "extention" should be --extension--;
Col. 4, line 47, "extention" should be --extension--;
Col. 4, line 51, "there" should be --their--;
Col. 6, line 27, "operating" should be --operation--;
Col. 6, line 45, "drapped" should be --draped--;
Col. 6, line 55, "microfische" should be --microfiche--.

Signed and Sealed this

Twenty-fourth Day of May, 1988

*Attest:*

*Attesting Officer*

DONALD J. QUIGG

*Commissioner of Patents and Trademarks*